US006849124B1

(12) United States Patent
Gasparrini et al.

(10) Patent No.: US 6,849,124 B1
(45) Date of Patent: Feb. 1, 2005

(54) SOAK ON SITE AND SOAK PRESS CLEANING SYSTEM AND METHOD OF USING SAME

(75) Inventors: C. Robert Gasparrini, Port Chester, NY (US); Peter E. Anselmo, Ridgefield, CT (US); Walter H. Cano, Bridgeport, CT (US)

(73) Assignee: Baldwin Graphics Systems, Inc., Shelton, CT (US)

( * ) Notice: Subject to any disclaimer, the term of this patent is extended or adjusted under 35 U.S.C. 154(b) by 0 days.

(21) Appl. No.: 09/094,991

(22) Filed: Jun. 15, 1998

Related U.S. Application Data

(62) Division of application No. 08/431,932, filed on May 1, 1995, now abandoned.

(51) Int. Cl.[7] ..... B05C 11/00

(52) U.S. Cl. ..... 118/72; 118/423; 118/117; 118/249

(58) Field of Search ..... 118/423, 33, 419, 118/72, 123, 126, 258, 117, 249, 427, 262, 115, 114, 250, 60, 67, 68, 424; 68/22 R; 26/272; 427/179, 428, 429, 369, 336

(56) References Cited

U.S. PATENT DOCUMENTS

| | | | | |
|---|---|---|---|---|
| 564,353 | A | * | 7/1896 | Wagg |
| 825,744 | A | * | 7/1906 | Millington |
| 1,128,200 | A | * | 2/1915 | Wagg |
| 1,393,296 | A | * | 10/1921 | Lomax |
| 1,468,351 | A | * | 9/1923 | Ayres |
| 2,611,717 | A | * | 9/1952 | Sooy et al. |
| 2,884,893 | A | * | 5/1959 | Kabelitz |
| 2,964,825 | A | * | 12/1960 | Cocker |

(List continued on next page.)

FOREIGN PATENT DOCUMENTS

| | | | |
|---|---|---|---|
| CA | 976030 | | 10/1975 |
| DE | 2004511 | | 8/1971 |
| DE | 2804801 | | 8/1979 |
| DE | 3736397 | | 5/1989 |
| DE | 3907611 | | 9/1990 |
| EP | 0741034 | A2 | 11/1996 |
| EP | 0741036 | A2 | 11/1996 |
| EP | 0747218 | A2 | 12/1996 |
| EP | 0741034 | A3 | 1/1997 |
| EP | 0747218 | A3 | 3/1997 |
| EP | 0741036 | A3 | 4/1997 |
| EP | 0741034 | B1 | 7/2000 |
| EP | 0741036 | B1 | 1/2001 |
| EP | 0747218 | B1 | 4/2002 |
| GB | 1149396 | | 4/1969 |

(List continued on next page.)

OTHER PUBLICATIONS

Coating Equipment and Processes, Lockwood Publishing Co., Inc. New York, NY. (1970) pp. 125–131 & 158–162.*

*Primary Examiner*—Brenda A. Lamb
(74) *Attorney, Agent, or Firm*—Morgan & Finnegan LLP

(57) ABSTRACT

An improved method and system for cleaning a cylinder of a printing press. One method involves soaking a strip of cleaning fabric on a press with a low volatility organic compound solvent. Excess solvent, if any, is removed to place the strip of cleaning fabric in functional equilibrium with the solvent. The cleaning fabric is then used to clean a cylinder. Alternatively, the strip of cleaning fabric is soaked on site by contacting the strip of cleaning fabric with the solvent and wrapping the strip of cleaning fabric into a cleaning fabric supply roll. The cleaning fabric is then brought in engagement with a printing press having a cylinder to be cleaned without disposing a sleeve around the fabric roll and without substantially disturbing the distribution of the solvent in the fabric roll and detrimentally affecting the cleaning ability of the fabric.

8 Claims, 9 Drawing Sheets

U.S. PATENT DOCUMENTS

| | | | | |
|---|---|---|---|---|
| 3,207,125 | A | * | 9/1965 | Strandberg |
| 3,448,529 | A | * | 6/1969 | Erspamer et al. |
| 3,521,600 | A | * | 7/1970 | Toya |
| 3,548,784 | A | * | 12/1970 | Wenger |
| 3,681,950 | A | * | 8/1972 | Fleissner |
| 3,704,151 | A | * | 11/1972 | Aronoff |
| 4,016,812 | A | | 4/1977 | Lauk et al. |
| 4,086,387 | A | * | 4/1978 | Triolo |
| 4,135,448 | A | | 1/1979 | Moestue |
| 4,339,481 | A | * | 7/1982 | Beekhuis |
| 4,344,361 | A | | 8/1982 | MacPhee et al. |
| 4,473,929 | A | * | 10/1984 | Green |
| 4,538,541 | A | * | 9/1985 | Zimmer |
| 4,642,164 | A | * | 2/1987 | Hanhikoski et al. |
| 4,860,883 | A | | 8/1989 | Knaul et al. |
| 4,867,064 | A | | 9/1989 | Hara et al. |
| 4,875,260 | A | * | 10/1989 | Vecchia |
| 4,934,391 | A | | 6/1990 | Futch et al. |
| 4,986,182 | A | | 1/1991 | Sawaguchi et al. |
| 5,009,716 | A | | 4/1991 | Gerson |
| 5,012,739 | A | | 5/1991 | Loos et al. |
| 5,069,128 | A | | 12/1991 | Hara et al. |
| 5,104,567 | A | | 4/1992 | Staehr |
| 5,125,342 | A | | 6/1992 | Hara |
| 5,143,639 | A | | 9/1992 | Krawack |
| 5,150,653 | A | | 9/1992 | Hara |
| 5,176,080 | A | | 1/1993 | Gasparrini et al. |
| 5,188,754 | A | | 2/1993 | Weltman et al. |
| 5,194,173 | A | | 3/1993 | Folkard et al. |
| 5,207,160 | A | | 5/1993 | Harada |
| 5,277,928 | A | * | 1/1994 | Strandberg |
| 5,368,157 | A | | 11/1994 | Gasparrini et al. |
| 5,450,792 | A | | 9/1995 | Gegenheimer et al. |
| 5,509,353 | A | | 4/1996 | Aoki |
| 5,974,976 | A | | 11/1999 | Gasparrini et al. |
| 6,263,795 | B1 | | 7/2001 | Gasparrini et al. |

FOREIGN PATENT DOCUMENTS

| | | |
|---|---|---|
| GB | 2004511 | 8/1971 |
| GB | 1329601 | 9/1973 |
| GB | 1401528 | 7/1975 |
| JP | 4823503 | 3/1973 |
| JP | 5149242 | 12/1976 |
| JP | 5601230 | 1/1981 |
| JP | 63020525 | 2/1988 |
| JP | 1127762 | 8/1989 |
| JP | 2008055 | 1/1990 |
| JP | 2011329 | 1/1990 |
| JP | 3001952 | 1/1991 |
| JP | 3017623 | 2/1991 |
| JP | 3043270 | 4/1991 |
| JP | 4258244 | 9/1992 |
| JP | 4113960 | 10/1992 |
| JP | 4126855 | 11/1992 |
| JP | 5015470 | 1/1993 |
| WO | WO 9406633 | 3/1994 |

* cited by examiner

1

SOAK ON SITE AND SOAK PRESS CLEANING SYSTEM AND METHOD OF USING SAME

This is a divisional of application Ser. No. 08/431,932 filed May 1, 1995, abandoned.

FIELD OF THE INVENTION

This invention relates to a cleaning system employing a strip of cleaning fabric wrapped around a core or a shaft to form a cleaning fabric supply roll. The strip of cleaning fabric is soaked at the site prior to use or is soaked on the press.

BACKGROUND OF THE INVENTION

A wide variety of blanket cleaning systems and apparatus employing the same to clean the cylinders of printing presses are known. Typical blanket cleaning systems and apparatus employing the same, including cleaning blankets and cleaning solutions, are exemplified by U.S. Pat. No. 4,135,448 to Moestue which is directed to a mechanism for cleaning a cylinder that is provided with a cleaning cloth which is wetted with a cleaning fluid or solution prior to its encountering the pressure roller; U.S. Pat. No. 4,934,391 to Futch et al. is directed to a composition for ink removal that exhibits a low vapor pressure and which is a low vapor pressure organic compound; U.S. Pat. No. 4,986,182 to Sawaguchi et al. is directed to a cleaning apparatus in which a cleaning cloth is dampened by a liquid; U.S. Pat. No. 5,009,716 to Gerson is directed to a wash for removing ink comprising a low volatile organic compound; U.S. Pat. No. 5,012,739 to Loos is directed to a washing device comprising a cleaning cloth dampened with a washing medium and U.S. Pat. No. 5,069,128 to Hara is directed to a device for cleaning a cylinder of a printing machine comprising a cleaning cloth impregnated with a cleaning liquid.

In addition, U.S. Pat. No. 5,104,567 to Staehr is directed to a liquid for cleaning ink from printing machines; U.S. Pat. No. 5,125,342 to Hara is directed to a method for cleaning the cylinder of a printing machine; and U.S. Pat. No. 5,143,639 to Krawack is directed to a cloth moistened with a low vapor pressure cleaning agent for removing ink; whereas U.S. Pat. No. 5,188,754 to Weltman et al. is directed to a cloth soaked with a cleaning formula and U.S. Pat. No. 5,194,173 to Folkard et al. is directed to a method for removing ink from printing machines. Still further, U.S. Pat. Nos. 4,344,361 and 4,757,763 to MacPhee et al. is directed to automatic blanket cylinder cleaners provided with cleaner fabrics adapted to contact the blanket cylinders of printing presses. On the other hand, U.S. Pat. No. 5,175,080 to Gasparrini et al. is directed to a cloth supply system for the blanket cylinder for use in printing presses.

While the above-mentioned patents accomplish their purposes to a satisfactory extent, they still exhibit a variety of drawbacks. For example, they usually require apparatus, such as pumps, spray bars, manifold lines, valves, and the like as part of the automatic blanket cleaning systems for introducing the cleaning solvents or solutions to the cleaning fabric just prior to actual use.

U.S. Pat. No. 5,368,157 to Gasparrini et al., the present applicants, attempted to overcome these problems. That patent is directed to a pre-packaged, pre-soaked cleaning system for use with printing machines or the like to clean the cylinders of such machines and which comprises a pre-soaked fabric roll saturated to equilibrium with low volatility organic compound solvent and which is disposed around an elongated, cylindrical core and a sealed or a shrunken and sealed plastic sleeve disposed around and in contact with the fabric roll, whereby the pre-soaked saturated roll can be transported and stored vertically and/or horizontally until use without substantially disturbing the distribution of the solvent in the fabric roll and detrimentally effecting the cleaning ability of the fabric.

While the invention disclosed in U.S. Pat. No. 5,368,157 works for its intended purpose, improvements have been discovered. When the patented product is placed in the vertical position, the solvent would shift downward in the evacuated package. When the package is restored to the horizontal position, the solvent migrates back towards equilibrium in the roll. This migration is caused by air pockets in the fabric of the roll.

There exists, therefore, a need for providing a blanket cleaning system which improves upon the above-mentioned conditions. The present invention fulfills such a need.

OBJECTS OF THE INVENTION

It is therefore an object of the invention to provide a new and improved system for soaking a strip of cleaning fabric for use in a cylinder cleaning system.

It is a further object of the invention to provide a new and improved system for soaking a strip of cleaning fabric which overcomes the drawbacks discussed above.

Another object of the invention is to provide a new and improved method in which a strip of cleaning fabric is presoaked on the same site as the press or in proximity to the press in which it is to be used to allow transportation of the presoaked cleaning fabric supply roll to the press without substantially disturbing the distribution of the solvent in the cleaning fabric supply roll and detrimentally affecting the cleaning ability of the fabric.

Another object of the invention is to provide a new and improved system in which a strip of cleaning fabric is soaked and saturated to functional equilibrium with a low volatility, organic compound solvent after it is unwound from a bulk roll but before it is wound into a cleaning fabric supply roll on a core or shaft.

Another object of the invention is to provide a new and improved method of soaking a strip of cleaning fabric on a cylinder cleaning apparatus while located on a press.

A yet another object of the invention is to provide a new and improved method of soaking a strip of cleaning fabric on a press while the strip of cleaning fabric is still wound in a cleaning fabric supply roll on a core or shaft.

A still further an object of the invention is to provide a new and improved method including the use of an adjustable means to remove excess solvent from the strip of cleaning fabric to control the amount of solvent retained by the strip of cleaning fabric.

A further object of the invention is to provide a new and improved soak on press system in which a single roller is used to both soak and saturate the strip of cleaning fabric in solvent and to remove excess solvent for the strip of cleaning fabric.

The foregoing specific objects and advantages of the invention are illustrative of those which can be achieved by the present invention and are not intended to be exhaustive or limiting of the possible advantages which may be realized. Thus, these and other objects and advantages of the invention will be apparent from the description herein or can be learned from practicing the invention, both as embodied herein or as modified in view of any variations which may be apparent to those of ordinary skill in the art, the same being realized and attained by means of parts, constructions, instrumentations and combinations pointed out in the claims. The present invention resides in the novel parts, constructions, arrangements, combinations, methods and improvements herein shown and described.

SUMMARY OF THE INVENTION

In accordance with the invention, there is provided a method of cleaning a cylinder of a printing press using a soak on press system comprising first placing a cleaning fabric supply roll having a strip of cleaning fabric in a cylinder cleaning system. Second, the strip of cleaning fabric is brought in contact with a low volatility, organic compound solvent or cleaning agent which does not evaporate readily at ambient temperature and pressure and soaking and saturating the strip of cleaning fabric with the solvent or cleaning agent. The soaking and saturating may occur while the strip of cleaning fabric is part of the cleaning fabric supply roll or after it has been unwound from the cleaning fabric supply roll. An optional third step is removing any excess solvent or cleaning agent from the strip of cleaning fabric to obtain a strip of cleaning fabric saturated to functional equilibrium. Fourth, the strip of cleaning fabric is used to clean a cylinder.

In a more specific aspect of the method, the used strip of cleaning fabric is wound up on a take-up roll.

In still another more specific aspect of the method, at least a portion of the cleaning fabric supply roll is dipped in a container containing the solvent. The rotation of the cleaning fabric supply roll preferably causes the entire cleaning fabric supply roll to be soaked and saturated with solvent.

In yet another aspect of the method, the strip of cleaning fabric is unwound from the cleaning fabric supply roll prior to being brought in contact with the solvent. In a preferred method of this aspect, the strip of cleaning fabric is brought in contact with the solvent by means of a dipping roller.

In another more specific aspect of the method, the excess solvent is removed by squeezing the strip of cleaning fabric, preferably by using a squeezing roller or rollers. In a more specific embodiment of the method, the roller used for dipping the strip of cleaning fabric is the same roller as that used for squeezing the strip of cleaning fabric. In another embodiment, the location of the squeezing roller(s) are adjustable to control the amount of solvent in the strip of cleaning fabric.

The invention also includes a soak on press assembly for use in a printing press cylinder cleaning system. The assembly comprises a mounting assembly affixed to a printing press. A cleaning fabric supply roll including a strip of cleaning fabric is rotatably mounted to the mounting assembly. Soaking means are used for soaking and saturating at least a portion of the strip of cleaning fabric with a low volatility, organic compound solvent which does not readily evaporate at ambient temperature and pressure and removal means used for removing excess solvent so that the strip of cleaning fabric is saturated to functional equilibrium with the solvent or cleaning agent. A cylinder cleaning means is used for bringing the strip of cleaning fabric into contact with a cylinder to be cleaned to clean the cylinder and the used strip of cleaning fabric is collected by a take-up means.

In another more specific embodiment, the soaking means contacts the strip of cleaning fabric to the solvent prior to its removal from the cleaning fabric supply roll.

In an alternate embodiment, the soaking means includes a roller means for placing the strip of cleaning fabric into said solvent to soak and saturate the strip of cleaning fabric. In a further more specific embodiment the removal means includes a squeezing means for squeezing excess solvent and, in one embodiment, said squeezing means and said roller means are a unitary structure.

The invention also comprises a soak on press assembly including a mounting assembly affixed to the printing press to support the soak on press assembly. A cleaning fabric supply roll including a strip of cleaning fabric is rotatably mounted on the mounting assembly. A low volatility, organic compound solvent which does not readily evaporate at ambient temperature and pressure is placed in a container in engagement with the mounting assembly and at least a portion of the cleaning cloth supply roll is placed within the solvent to soak and saturate the strip of cleaning fabric. At least one squeezing roller is operatively associated with the strip of cleaning fabric to removing excess solvent from the strip of cleaning fabric to obtain a strip of cleaning fabric saturated to functional equilibrium with solvent. Preferably, at least one roller is operatively associated with and in a movedly fixed relationship with a surface of the container for removing excess solvent from the strip of cleaning fabric by squeezing it between the squeezing roller and the side of the container.

An alternate embodiment of the invention may also comprise a mounting assembly affixed to said printing press for supporting the soak on press assembly. A cleaning fabric supply roll including a strip of cleaning fabric is rotatably mounted on the mounting assembly. A low volatility, organic compound solvent which does not readily evaporate at ambient temperature and pressure located in at least one container engaged with the mounting assembly. A dipper is at least partially submersed in the solvent. The strip of cleaning fabric is adjacent the dipper so that the strip of cleaning fabric is soaked and saturated with the solvent. The strip of cleaning fabric is located in a gap between, and in contact with, a surface of the container and a squeezer so that the strip of cleaning fabric is squeezed and the excess solvent removed and placed in the container and the strip of cleaning fabric is placed in functional equilibrium. A cylinder cleaning means is used for bringing the saturated to functional equilibrium strip of cleaning fabric into contact with a cylinder to be cleaned and the cleaning apparatus. A take-up means is used for collecting the used strip of cleaning fabric.

In a more specific embodiment, a single container is used to store the solvent. In such an embodiment, the dipper and the squeezer may both be the same roller. In a different embodiment, the dipper and/or the squeezer are individual rollers.

The invention also includes a method for presoaking a strip of cleaning fabric on site. Broadly, the method includes contacting a strip of cleaning fabric with a low volatility, organic compound solvent which does not readily evaporate at ambient temperature and pressure and soaking and saturating the strip of cleaning fabric with the solvent. The strip of cleaning fabric is wrapped on a core or shaft to form a cleaning fabric supply roll. The cleaning fabric supply roll is engaged with a printing press having a cylinder to be cleaned without disposing a sealed plastic sleeve about the fabric roll and without substantially disturbing the distribution of the solvent in the cleaning fabric supply roll and detrimentally affecting the cleaning ability of the strip of fabric.

Preferably, after contacting the strip of cleaning fabric to the solvent, the strip of cleaning fabric is saturated to functional equilibrium. The preferred method of achieving this result is measured absorption of the solvent. Alternatively, excess solvent may be removed from the saturated strip of cleaning fabric.

In another embodiment of a method for soaking a strip of cleaning fabric, a strip of cleaning fabric is unwound from a bulk roll. A low volatility, organic compound solvent which does not readily evaporate at ambient pressure and temperature is applied to at least one roller. The unwound strip of cleaning fabric is brought in contact with at least one roller to soak and saturate the strip of cleaning fabric with solvent. Preferably, the strip of cleaning fabric is saturated to functional equilibrium with the solvent. The soaked and saturated strip of cleaning fabric is wound on a core or directly on a shaft to form a cleaning fabric supply roll.

It will be appreciated by those skilled in the art that the foregoing summary of the invention and the following detailed description are merely exemplary and explanatory of the present invention, but are not intended to be restrictive thereof or limiting of the advantages which can be achieved by the invention or various combinations thereof. The accompanying drawings referred to herein and constituting in part hereof, illustrate preferred embodiments of the invention and, together with the detailed description, serve to explain the principles of the invention.

BRIEF DESCRIPTION OF THE DRAWINGS

In order to understand the invention more fully, reference is directed to the accompanying drawings, which is to be taken in conjunction with the following description of the invention and in which drawing.

DESCRIPTION OF THE PREFERRED EMBODIMENTS

Figure 1A:
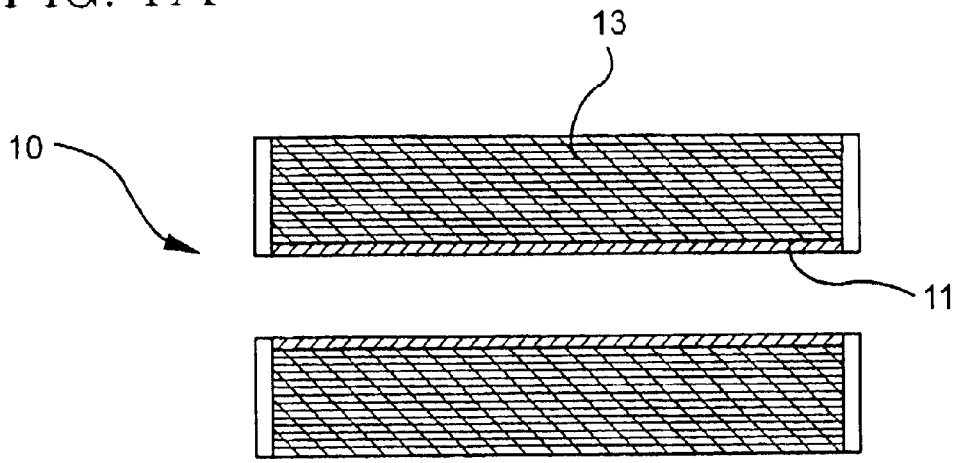
FIG. 1A is a lateral, sectional, elevational view of a cleaning fabric supply roll formed around a core.
Figure 1B:
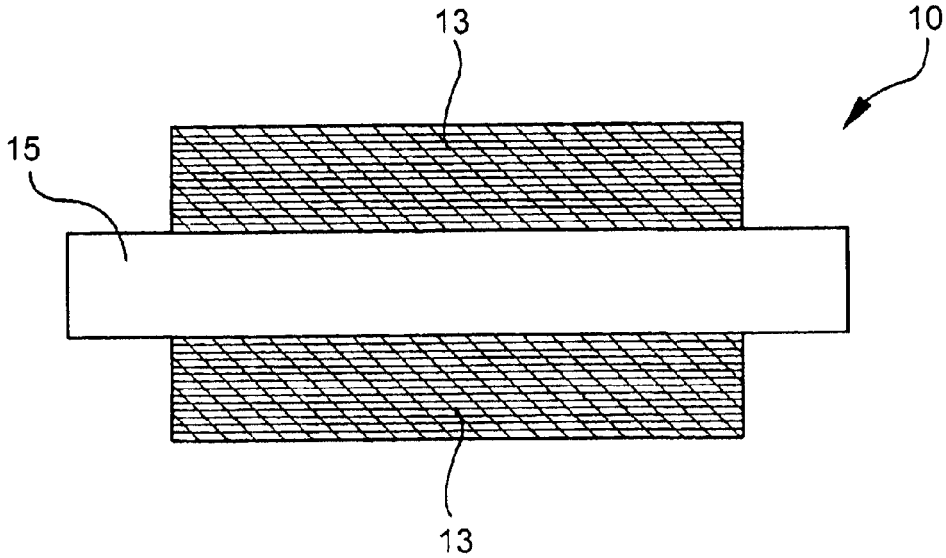
FIG. 1B is a lateral, sectional, elevational view of a cleaning fabric supply roll formed around a shaft.

Referring now to FIGS. 1A and 1B, a cleaning fabric supply roll 10 used with the present invention is shown. One embodiment, shown in FIG. 1A comprises an elongated core 11 made from, for example, relatively heavy cardboard of sufficient strength so that it can support thereon a strip of cleaning fabric 13. The strip of cleaning fabric 13 is wound around core 11. Alternatively, if desired, the core 11 can be made from any other suitable material including, but not limited to, plastic or metal, such as steel, aluminum, and the like. Core 11 preferably has open ends to allow installation on an appropriate cylinder cleaning apparatus. Preferably, core 11 is completely hollow to allow a shaft, rod, or the like 15 to be inserted within core 11 to provide installation in the cylinder cleaning apparatus. In such an embodiment, cleaning fabric supply roll 10 comprises core 11 and strip of cleaning fabric 13. In an alternate embodiment shown in FIG. 1B, cleaning fabric supply roll 10 is formed by winding the strip of cleaning fabric 13 directly around shaft 15. Preferably, the core 11 and/or shaft 15 is cylindrical in shape. However, the core 11 and/or shaft 15 may be any other appropriate shape, such as having 3, 4, 5, or 6 sides or an oval. Such shapes are described in concurrently filed application entitled "MOUNTING MECHANISMS FOR CLOTH ROLLS ON PRESS CYLINDER CLEANING DEVICES," an application filed by applicant C. Robert Gasparrini and commonly assigned, hereby incorporated by reference.

The strip of cleaning fabric 11 from which the cleaning fabric supply roll 10 is made may vary widely. For example, it may be made of paper, cloth, film, a mixture of wood pulp and polyester, such as DuPont SONTARA, or any other suitable material. In those cases where a cloth fabric is employed, it may be a woven or non-woven cloth fabric made of synthetic or natural fibers or mixtures of the same. Exemplative, but not limitative, of suitable synthetic fibers which may be used in the cloth fabrics are polyester fibers, rayon fibers, nylon fibers, and acrylic fibers and the like. Exemplative, but not limitative, of the natural fibers which may be employed are cotton fibers, wood pulp fiber, hemp fibers and the like.

In those cases where paper is employed as the fabric material, paper fabrics made from wood pulp modified chemically in accordance with paper manufacturing technology are suitable.

On the other hand, no matter what fabric is employed in carrying out the practice of this invention, it is preferred that the materials used therein exhibit high acceptability to being soaked or wetted by a solvent or cleaning agent. Preferably, this solvent or cleaning agent is a low volatility organic compound used to saturate the fabric. In this regard, it is preferred that the fabric employed be one which has a caliper thickness in a range from about 0.003 inches to about 0.030 inches, and preferably in a range from about 0.008 inches to about 0.020 inches, and the ability, when saturated with low volatility organic compound solvent, to retain from about 0.02 cc to about 0.5 cc of solvent per $in^2$ of fabric determined by routine testing methods.

In general, woven and non-woven fabrics suitable for use in carrying out the practice of the invention have a basic weight in a range of from about 1.5 ounces per square yard to about 6.0 ounces per square yard, a caliper thickness in the range mentioned above, a tensile strength in the longitudinal (machine) direction in a range of from about 20 lbs. per inch to about 200 lbs. per inch and in a width (cross) direction in a range from about 15 lbs. per inch to about 125 lbs. per inch.

When paper is employed as a cleaning fabric in the system of this invention, it preferably has a basis weight in a range of from about 40 lbs. to about 90 lbs., a caliper thickness in a range of from about 0.003 inches to about 0.10 inches, a tensile strength in the longitudinal (machine) direction in a range of from about 20 lbs. per inch to about 80 lbs. per inch and in the width (cross) direction in a range of from about 15 lbs. per inch to about 50 lbs. per inch, a porosity in a range of from about 1.0 second to about 10 seconds when subjected to 100 cc of low volatility organic compound solvent or water, and a stretch ability in a range of from about 1.0 percent to about 6.0 percent all determined by routine testing methods.

The low volatility organic compound solvent 20 employed in carrying out the practice of this invention may vary widely and generally it includes at least one low vitality organic compound solvent which does not readily evaporate, as well as mixtures of the same with similar low volatile organic compound solvents or with normally volatile organic compound solvents. Exemplative, but not limitative, of suitable solvent materials of this type are organic compound solvents selected from vegetable oils and citrus oils and the like. Generally, such solvent materials have a volatility in a range of from about zero up to about 30.0 percent, and preferably a volatility in a range of from about zero percent to about 20.0 percent, determined by routine testing methods. It is to be understood that within the purview of this invention, such suitable solvents also include normally volatile organic compound solvents, that is, those which readily evaporate and which are selected from mineral spirits and aliphatic hydrocarbon solvents and the like. Such solvent materials generally have a volatility of from zero up to about 100 percent determined by routine testing methods. Preferably, a low volatility solvent will be used because the lower the volatility of the solvent, the longer the fabric stays wet since less solvent evaporates. The closer the volatility is to zero percent, the longer the life of the presoaked fabric on the printing press cylinder cleaning apparatus It is to be understood that within the context of this invention, the terminology "saturated to equilibrium" as it is used in connection with the saturation of the fabric and/or fabric roll with solvent means by measured absorption or after removing the excess solvent from the fabric and/or fabric roll, the fabric and/or fabric roll retains therein sufficient solvent or cleaning agent in an amount to wet the fabric to the extent that it imparts efficient cleaning ability to the fabric to clean cylinders of apparatus, such as printing machinery, and the fabric has preferably retained therein by measured absorption or after removal of the excess, if any removal is required, from about 0.02 cc to about 0.5 cc of solvent per $in^2$ of fabric.

The above described cleaning fabric supply roll 10 and low volatility, organic compound solvent 20 may be used in either a soak on press assembly or a soak on site system.

Figure 2:
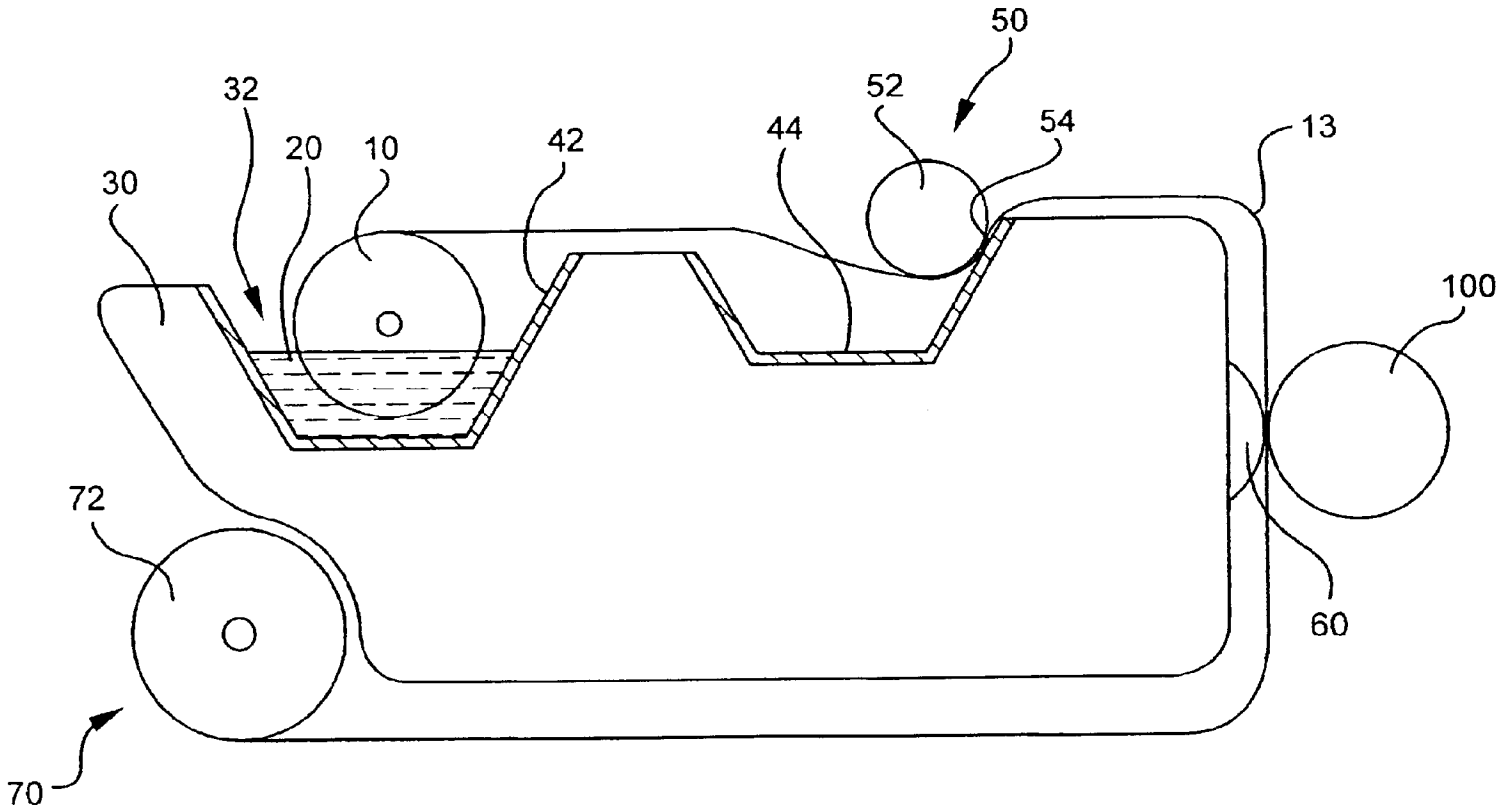
FIG. 2 is a cross-sectional view of a soak on press assembly according to the present invention including soaking the cleaning fabric supply roll in solvent.

A soak on press assembly 1 is shown in FIG. 2. Soak on press assembly 1 is a cleaning apparatus mounted on a printing press (not shown) to prepare a strip of cleaning fabric to clean a cylinder 100. A mounting assembly 30 is affixed to the printing press and supports the soak on press assembly 1. Mounting assembly 30 may be a unitary structure. Alternatively, mounting assembly 30 may comprise several discrete pieces which are individually used to attach elements of the soak on press assembly 1 to the printing press. In yet a third embodiment, the mounting assembly 30 comprises those elements of a printing press which supports elements of the soak on press assembly 1.

Cleaning fabric supply roll 10 is preferably rotatably mounted to mounting assembly 1.

A container 42 is used to store solvent 20 while strip of cleaning fabric 13 is soaked and saturated in solvent 20. In one embodiment, the container 42 is in engagement with a mounting assembly 30. In an alternate, container 42 is placed in a duct 32 of mounting assembly 30. In another embodiment, container 42 is a duct 32 of mounting assembly 30. Preferably, container 42 is removably connected to mounting assembly 30 to allow container 42 to be easily cleaned and solvent 20 easily replaced.

Cleaning fabric supply roll 10 needs to be placed in contact with the solvent 20 so that strip of cleaning fabric 13 my be soaked and saturated. One method of achieving this result is to dip all cleaning fabric supply roll 10 into solvent 20 contained in container 42. For purposes of this invention, cleaning fabric supply roll 10 includes only the portion of strip of fabric 13 wrapped around core 11 and/or shaft 15 and not the portion of strip of cleaning fabric 13 threaded through the rest of the soak on press assembly 1. Preferably, cleaning fabric supply roll 10 is dipped in solvent 20 and strip of cleaning fabric 13 is soaked and saturated with solvent prior to any portion of strip of cleaning fabric 13 being threaded through the rest of soak on press assembly 1. Alternatively, a portion of strip of cleaning fabric 13 may be unwound from cleaning fabric supply roll 10 prior to cleaning fabric supply roll 10 being brought in contact with the solvent 20. After the strip of cleaning fabric 13 of cleaning fabric supply roll 10 has been soaked and saturated, all of cleaning fabric supply roll 10 may remain in solvent 20, a portion of cleaning fabric supply roll 10 may be removed from solvent 20, or all of cleaning fabric supply roll 10 may be removed from solvent 20.

In an alternate embodiment, only a portion, but at least half, of cleaning fabric supply roll 10 is brought in contact with solvent 20 and remains in contact during operation of the printing press. The unwinding of cleaning fabric supply roll 10 causes cleaning fabric supply roll 10 to rotate and the strip of cleaning fabric 13 wrapped around core 11 and/or shaft 15 that was not in contact with the solvent 20 is placed in solvent 20 and allowed to soak and saturate.

In order for maximum efficiency, the strip of cleaning fabric 13 after it has been removed from cleaning fabric supply roll 10 should be in functional equilibrium with solvent 20. Preferably, this is achieved through measured absorption of solvent 20. Alternatively, excess solvent strip of cleaning fabric 13 can be removed by any appropriate means to obtain a strip of cleaning fabric 13 saturated to functional equilibrium with solvent 20.

One way of removing excess solvent from a strip of cleaning fabric 13 is to use a squeezer 50 to squeeze out excess solvent. In one embodiment, squeezer 50 may comprise at least a pair of rollers with a gap between them. The strip of cleaning fabric 13 is placed between the rollers and the excess solvent is squeezed from the strip of cleaning fabric 13. By controlling the size of the gap between the at least two rollers, the amount of excess solvent removed is controlled and regulated. In an alternate embodiment, squeezer 50 may comprise a squeezing roller 52, which is rotatably mounted, and a squeezing surface 54. Squeezing roller 52 is disposed so that it is not engaged with squeezing surface 54 and a gap is formed between squeezing surface 54 and squeezing roller 52. Squeezing roller 52 is preferably in a movedly fixed relationship with squeezing surface 54 such that squeezing rollers 52 in its position to facilitate the removal of excess solvent yet may be moved to change the size of the gap between surface 54 and roller 52 to control and regulate the amount of solvent being removed from the strip of cleaning fabric 13. If squeezing roller 52 is movably mounted, it may be place adjacent to squeezing surface 54.

As with container 42, container 44 may be engaged with mounting assembly 30, may be placed within a duct 34 of mounting assembly 30, may be duct 34 of mounting assembly 30, or any combination of the above. Additionally, any other type of container 44 may be used. Preferably, surface 54 is an element of container 44. Alternatively, squeezing surface 54 may be a surface of mounting assembly 30.

It is preferred that after the removal of excess solvent, the strip of cleaning fabric 13 is saturated to functional equilibrium with solvent. A cylinder cleaning means is used to bring the strip of cleaning fabric 13 in contact with a cylinder to be cleaned and causes the cylinder 100 to be cleaned. Examples of cylinder cleaning means can be found in U.S. patent application Ser. No. 07/955,694 filed Oct. 2, 1992 by Harold W. Gegenheimer et al. entitled "AUTOMATIC CLEANING SYSTEM FOR PRESS ROLLERS AND CYLINDERS", U.S. Pat. No. 4,867,064 issued Sep. 19, 1989 to Hara et al. entitled "APPARATUS FOR CLEANING A PRINTING CYLINDER", and U.S. Pat. No. 5,150,653 issued Sep. 29, 1992 to Hara entitled "METHOD OF AND APPARATUS FOR CLEANING A CYLINDER", all of which are hereby, incorporated by reference.

After being used to clean cylinder 100, the used portion of the strip of cleaning cloth 13 is taken up by a take-up means 70. Preferably, take-up means 70 is a take-up shaft 72 rotatably mounted to mounting assembly 70. A take-up roll is formed by winding the used strip of cleaning fabric 13 around the take-up shaft 72. Examples of take-up shaft 72 can be found in concurrently filed application entitled "MOUNTING MECHANISMS FOR CLOTH ROLLS ON PRESS CYLINDER CLEANING DEVICES," an application filed by applicant C. Robert Gasparrini and commonly assigned, hereby incorporated by reference.

Figure 3:
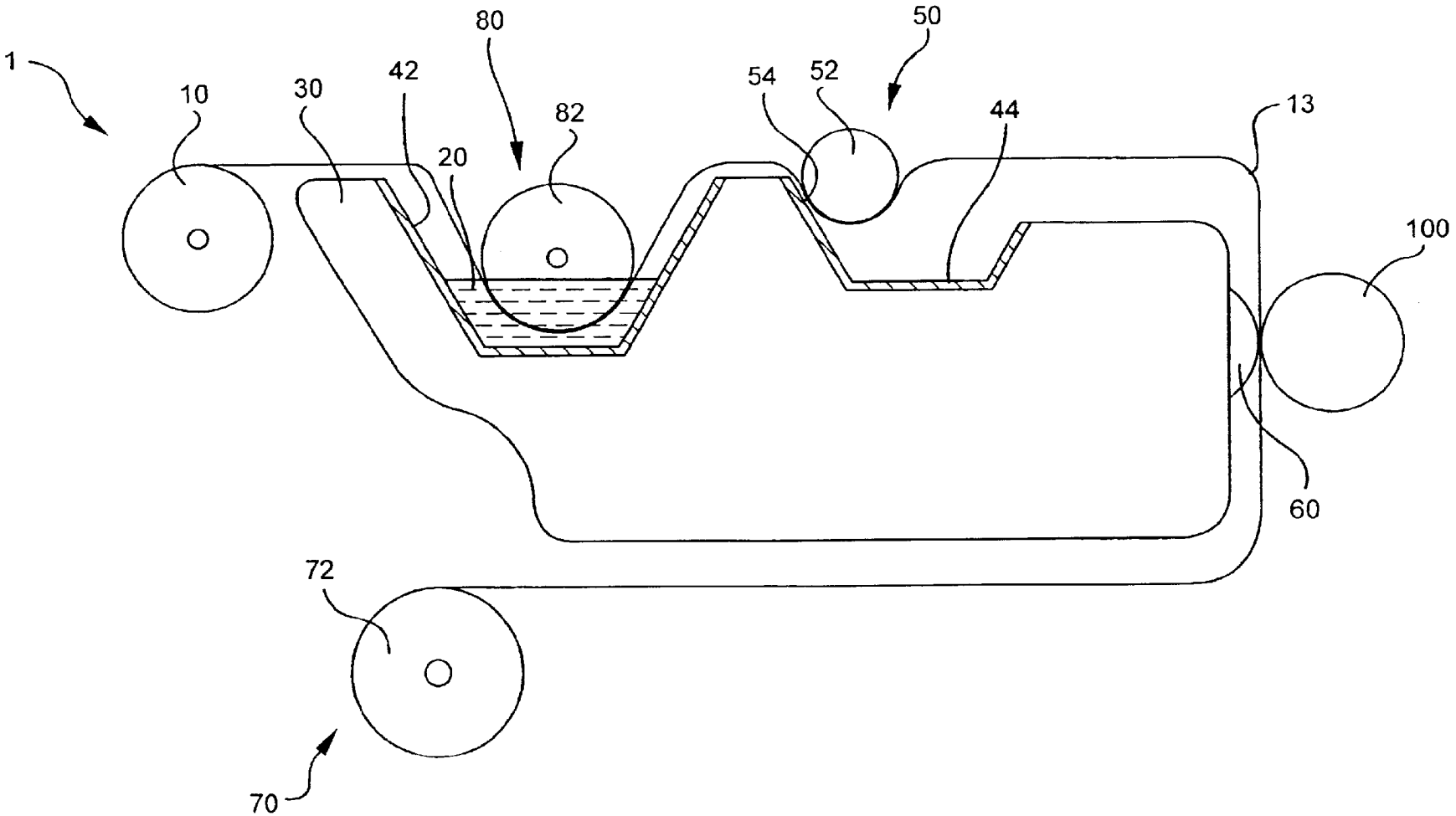
FIG. 3 is a cross-sectional view of a soak on press assembly according to the present invention including a single duct or container for storing solvent.

FIG. 3 demonstrates an alternate embodiment of the invention. In this embodiment, cleaning cloth supply roll 10 is not soaked and saturated in solvent 20. Instead, the strip of cleaning fabric 13 is at least partially removed from the cleaning cloth supply roll 10. A soaking means 80 is used for soaking and saturating at least a portion of the strip of cleaning fabric 13 in solvent 20. In this embodiment, the soaking means 80 includes a dipper 82 and a container 42. Container 42 is used to store the solvent while dipper 82 is placed at least partially in the solvent 20. Dipper 82 is used to place the at least a portion of the strip of cleaning fabric 13 in solvent 20 and to allow the strip of cleaning fabric 13 to soak and saturate in the solvent 20. Preferably, dipper 82 is a roller rotatably mounted to the mounting assembly; however, any appropriate dipper may be used. The remainder of the soak on press assembly 1 functions the same as that described for the device shown in FIG. 2.

Figure 4:
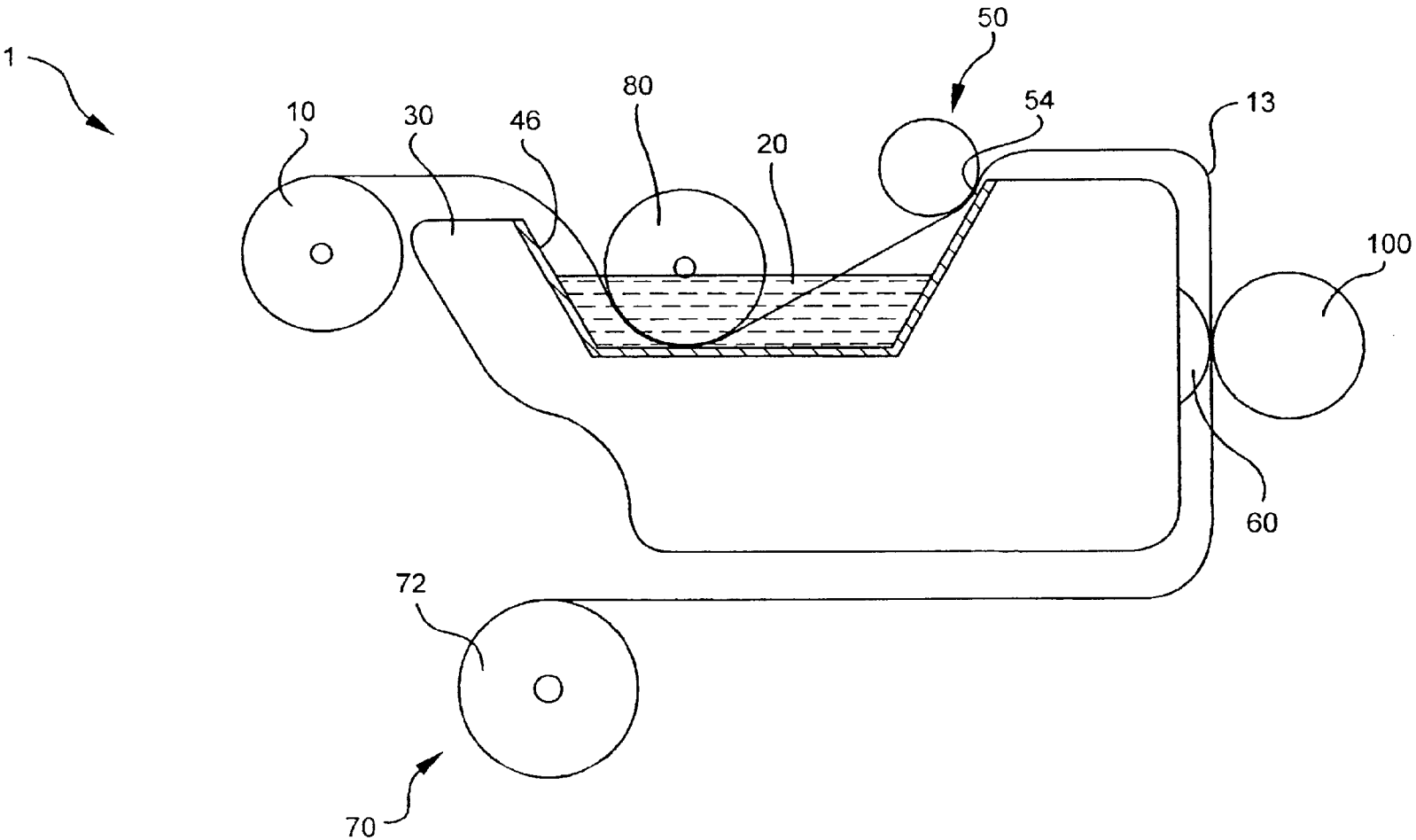
FIG. 4 is a cross-sectional view of a soak on press assembly according to the present invention including separate ducts for storing solvent to be applied and removed excess solvent.

An improved embodiment of the invention is shown in FIG. 4. In this embodiment, instead of having a solvent storage container 42 and a removed excess solvent storage container 44, only a single storage container 46 is used. Because the removed excess solvent can be used immediately without the need to move it from one container 44 to a second container 42, the soak on press assembly 1 can be operated for a longer period of time before the container needs to be cleaned and/or refilled.

As with containers 42 and 44, container 46 may be constructed in a variety of fashions. For example, container 46 may be fixed, either permanently or, preferably, removably, to mounting assembly 30. Container 46 may be placed or fixed within a duct 36 of mounting assembly 30. Alternatively, duct 36 may be used at the container. On the other hand, any combination of the above may be used. For example, container 46 may comprise a container placed within a duct and having the duct extend beyond the container. Alternatively, any other appropriate construction of container 46 may be used.

In another embodiment, multiple containers 46 are used. In each of these containers 46, the strip of cleaning fabric 13 is both soaked and saturated with solvent 20 and excess solvent is removed from the soaked and saturated strip of cleaning fabric 13.

Figure 5:
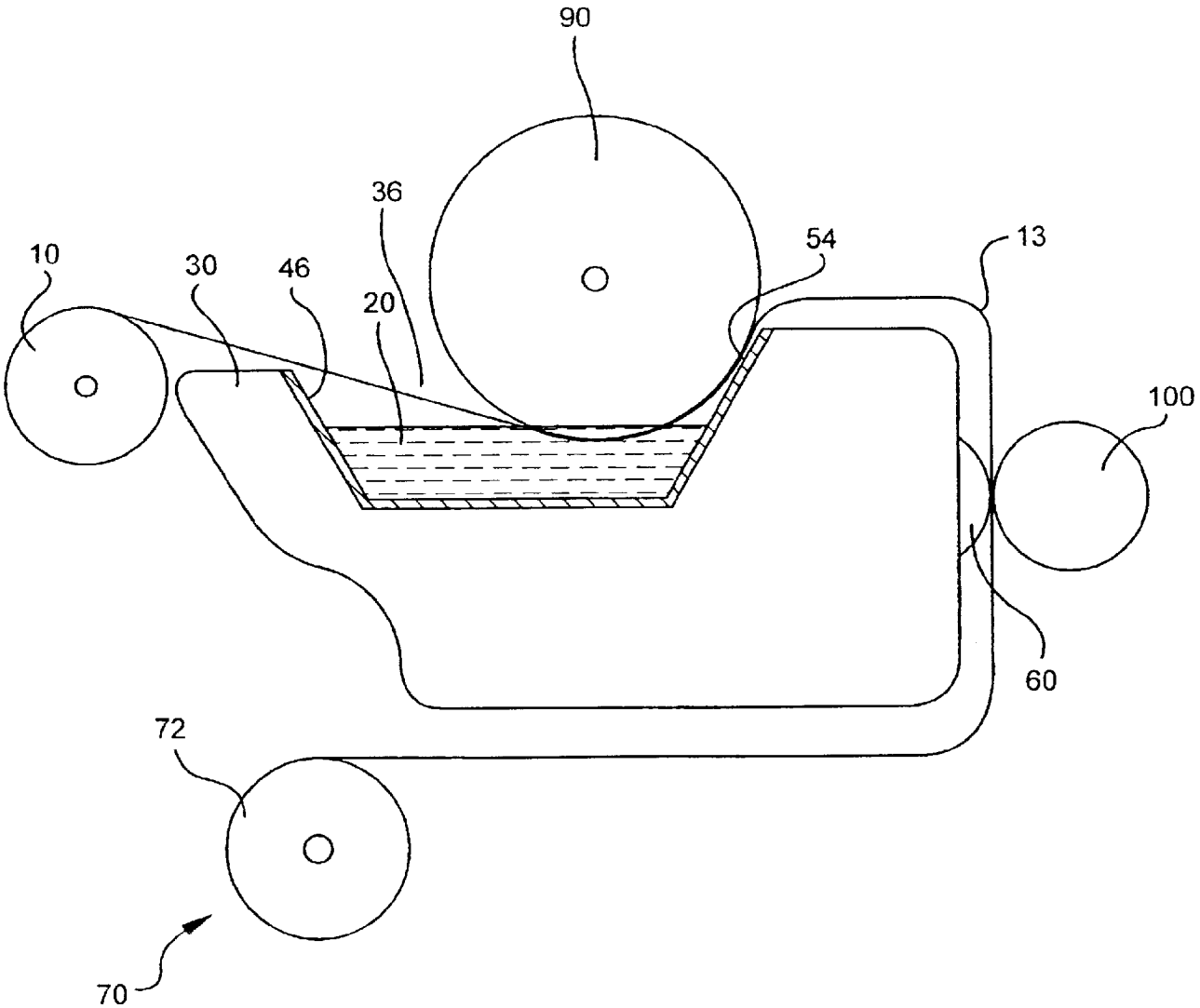
FIG. 5 is a cross-sectional view of a soak on press assembly according to the present invention including a single roller to dip and squeeze the strip of cleaning fabric.

FIG. 5 an improvement to the single container embodiment described above, a single body 90 is used to both dip the strip of cleaning fabric into solvent 20 stored in container 46 to allow the strip of cleaning fabric 13 to soak and saturate in the solvent and to remove the excess solvent by squeezing the soaked and saturated strip of cleaning fabric 13 between the body 90 and squeezing surface 54. Preferably, body 90 is a roller which is rotatably mounted to mounting assembly 30. In this embodiment, body 90 may be mounted to allow movement relative to surface 54 to control and regulate the amount of excess solvent being removed.

An alternate approach to achieving the advantages of the invention is to presoak the strip of cleaning cloth 13 on site, that is near enough to the press that the presoaked cleaning cloth can be brought to or in the proximity of the press containing the cylinder to be cleaned without disposing a sealed and/or heat-sealed plastic sleeve about the cleaning fabric roll 10 and without substantially disturbing the distribution of the solvent in the fabric roll and detrimentally affecting the cleaning ability of the fabric.

In accordance with a method of this invention, a strip of cleaning fabric 13 is brought in contact with a low viscosity, organic compound solvent which does not readily evaporate at ambient pressure and temperature. Contact between the strip of cleaning fabric 13 and the solvent 20 may be achieved in a variety of ways. For example, solvent may be applied in measured amounts so that the fabric is presoaked to functional equilibrium. This preferred method of applying solvent is known as measured absorption of a solvent. If desired, instead of measured absorption, an excess amount of solvent may be applied to the strip of cleaning fabric. This may be done by soaking and saturating the strip of cleaning fabric in a vat of solvent. If this is done, the excess solvent must be removed to obtain a strip of cleaning fabric saturated to functional equilibrium with the solvent. Any appropriate method for removing the excess solvent to obtain a strip of cleaning fabric saturated to functional equilibrium can be used with any of the above methods of contacting, including draining the strip of cleaning fabric or spinning the strip of cleaning fabric. The strip of cleaning fabric is presoaked and saturated with a low volatility, organic compound solvent before or after the strip of cleaning fabric 13 is wound to form a cleaning fabric supply roll 10.

Figure 6:
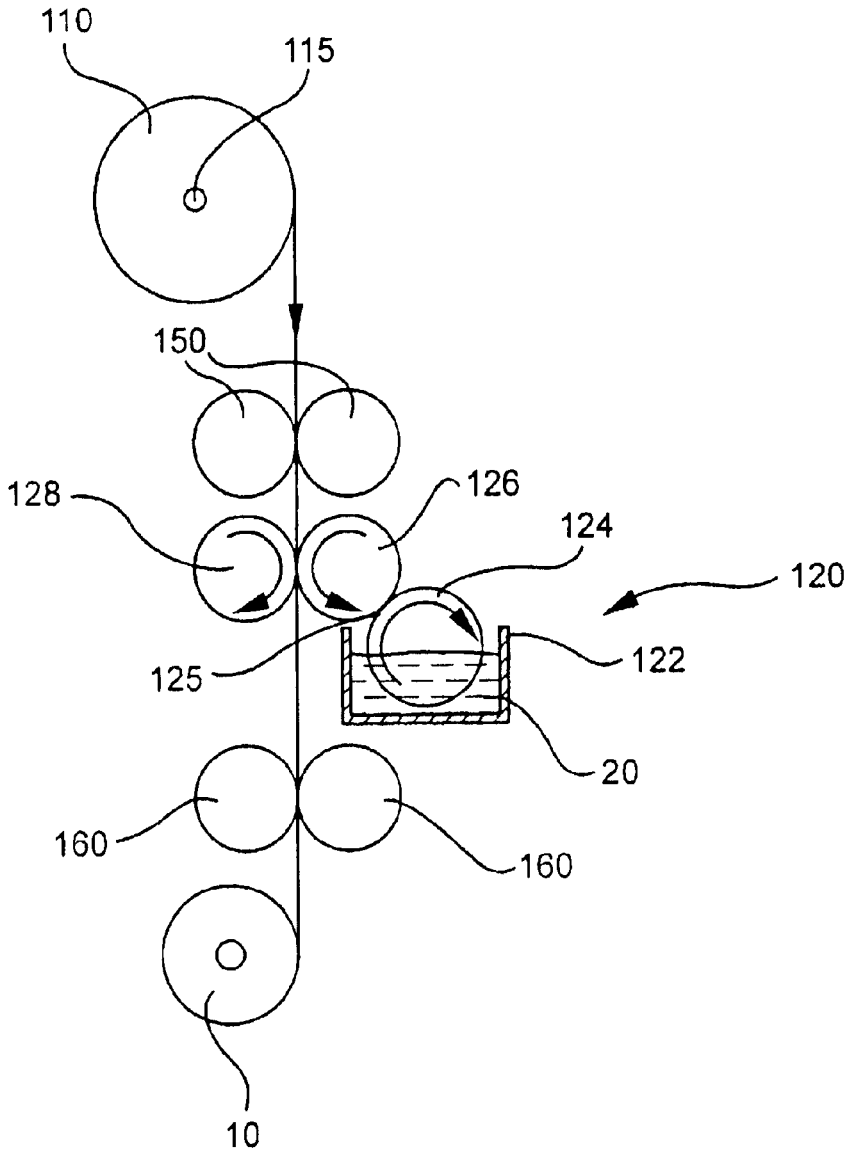
FIG. 6 is a cross-sectional view of a soak on site system according to the present invention.

An alternative embodiment of a method of presoaking a strip of cleaning fabric on site is shown in FIG. 6. A strip of cleaning fabric 13 is initially wound around a shaft or core 115 to form bulk roll 110. Bulk roll 110 is rotatably mounted to a roll forming assembly. The amount of fabric on bulk roll 110 may be sufficient to form multiple cleaning fabric rolls 10. A portion of the strip of cleaning fabric 13 is unwound from bulk roll 110. If desired, at least a pair of calendering rollers 150 may be used to calender the strip of cleaning fabric 13. The at least a pair of calendering rollers 150 compress the strip of cleaning fabric 13. Preferably, but not necessarily, the temperature of the at least a pair of rollers 150 is hotter than room temperature. Alternatively, the temperature of the at least a pair of rollers 150 is at about ambient temperature or less than ambient temperature. It has been found that the wettability and the distribution of the solvent is very good in the calenderized fabric.

A surprising and unexpected result of the calendaring process is that the length of fabric is increased while not increasing the diameter of the cleaning fabric supply roll 10. This provides an important advantage because cleaners are designed to accept fabric rolls of up to a certain diameter. For example, one of the assignor's automatic blanket cleaners will only accept a cleaning fabric roll having a diameter of about 2.75 inches. Because of this extra length, a fabric roll of calenderized cloth will be usable for more washes than a regular fabric roll of the same fabric having the same diameter. This has two advantages. First, the cost per wash will be reduced. Second, the pressmen need not change a roll of cleaning fabric as often since there are more washes per roll of cloth. This will allow for the press to be run more often. These advantages can be realized regardless of whether the fabric is pre-soaked and/or pre-packaged.

The amount of increase in the length of cloth due to calendaring is dependent on the fabric used and the amount of calendaring. For example when DuPont SONTARA cloth having a thickness of about 0.012 inches and a length of about 12 yards is placed about a core, having a diameter of about 1.5 inches, the fabric roll has a diameter of 2.75 inches. After being calendered the cloth has a thickness of about 0.0085 inches and a length of about 16 yards and still has a diameter of about 2.75 inches when placed on the same core. Thus, in this situation, calendering results in an about 25% to about 30% increase in the length of the fabric without increasing the diameter of cleaning fabric supply roll 10. Depending on the type of fabric and amount of calendering, results may range from about a 10% increase to about a 50% increase.

Calendaring fabric and its advantages are discussed in more detail in the United States patent application by C. Robert Gasparrini and Walter H. Cano entitled "CLEANING SYSTEM AND PROCESS FOR MAKING SAME EMPLOYING REDUCED AIR CLEANING FABRIC" filed concurrently herewith and hereby incorporated by reference.

A solvent application system 120 is used to apply a measured amount of solvent 20 to the strip of cleaning fabric 13. A container 122 is used to store solvent 20. A solvent supply roller 124, which is rotatably mounted, is partially submerged in solvent 20. A rotatably mounted application roller 126 is positioned adjacent to and in contact with the solvent supply roller 124 at a portion of the solvent supply roller 124 which is not submerged in the solvent 20. Solvent supply roller 124 and application roller 126 are rotatably mounted such that they rotate in the opposite direction. The rotation of solvent supply roller 124 and application roller 126 cause solvent 20 to transfer from solvent supply roller 124 to application roller 126 via nip 125. If desired, a plurality of solvent supply rollers 126 may be used to transport solvent 20 from container 122 to the application roller 126. In such an embodiment, the plurality of solvent supply rollers 124 are adjacent to and in contact with each other to form a chain of rollers such that one solvent supply roller 124 is submerged in solvent 20 and another solvent supply roller 124 is in contact and adjacent to application roller 126. The strip of cleaning fabric 13 is placed between and adjacent to a rotating roller 128 and application roller 126. The rotation application roller 126 causes a measured amount of solvent 20 to be placed in contact with the strip of cleaning fabric 13 and allowing the fabric 13 to be soaked and saturated with the solvent 20. Preferably, the strip of cleaning fabric 13 is soaked and saturated to functional equilibrium with the solvent 20. Alternatively, an excess amount of solvent may be used to soak and saturate the strip of cleaning fabric 13. Such excess solvent can be removed by any appropriate means including, but not limited to, running the strip of fabric 13 through at least a pair of rollers 160. The soaked and saturated strip of cleaning fabric 13 is then wound around a core, shaft or any other appropriate body to form a cleaning fabric supply roll 10. The excess solvent, if any is applied to the fabric, may be removed either before or after the cleaning fabric supply roll 10 is formed. When a cleaning fabric supply roll 10 of an appropriate diameter is formed, the strip of cleaning fabric 13 is cut or torn, cleaning fabric supply roll 10 is removed, and a new shaft or core is used to form another cleaning fabric supply roll.

In the above described system, the winding of the strip of cleaning fabric 13 into a cleaning fabric supply roll 10 may cause the strip of cleaning fabric 13 to move through the solvent application system 120, the at least a pair of calendering rollers 150 (if used) and the pair of rollers 160 (if used).

The solvent application system 120 including all its elements, calendaring rollers 150, pair of rollers 160, and cleaning fabric supply roll 10 may all be attached to a roll forming assembly.

Figure 7:
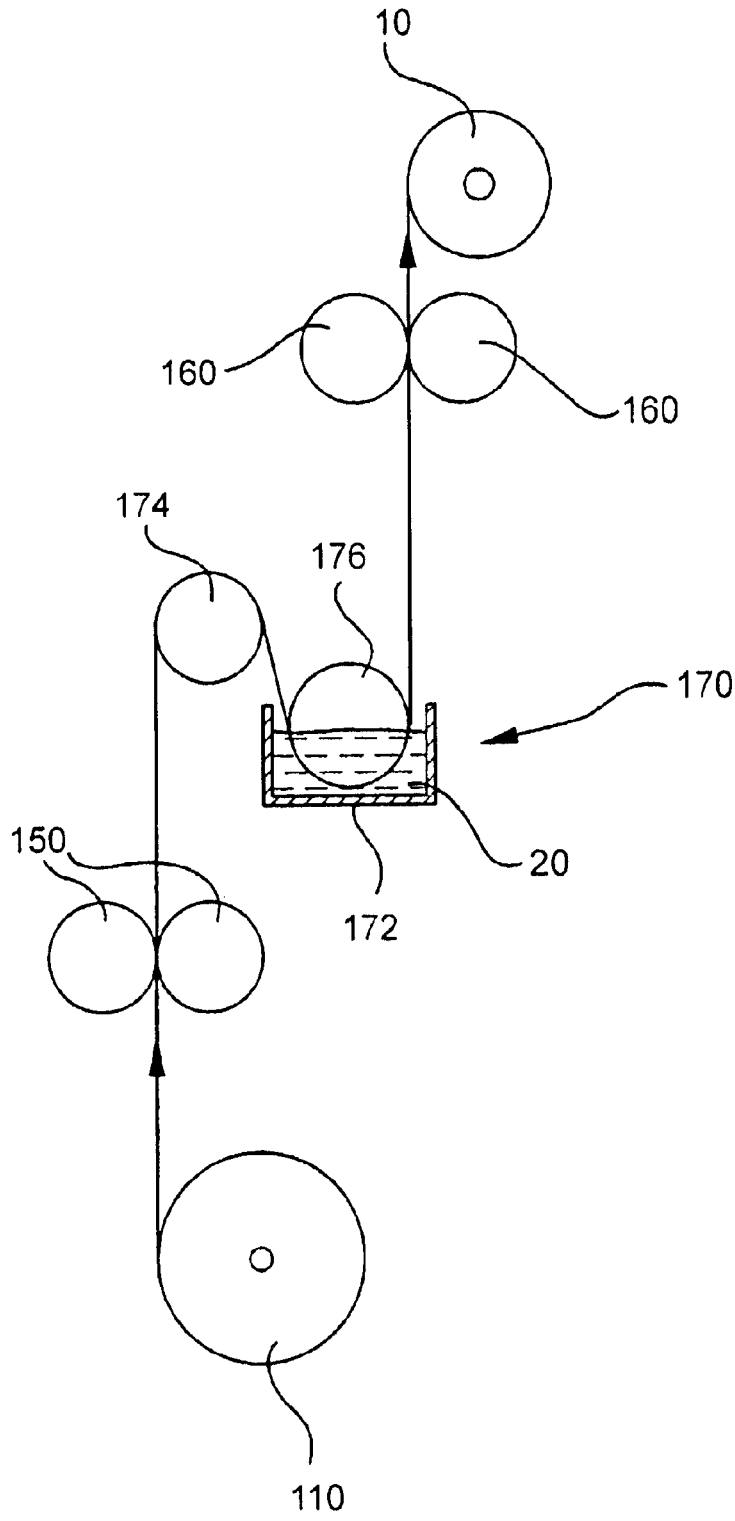
FIG. 7 is a cross-sectional view of an alternate embodiment of a soak on site system according to the present invention including separate rollers for applying solvent and removing excess solvent.

A soak on site system using an alternate solvent application system 170 is shown in FIG. 7. At least one placement device 174, preferably a roller, is used to place the strip of cleaning fabric 13 above a container 172 storing a low volatility, organic compound solvent 20 which does not readily evaporate at ambient pressure and temperature. A dipper 176, preferably a rotatably mounted roller, is used to dip the strip of cleaning fabric 13 into the solvent 20. This allows the strip of cleaning fabric 13 to soak and saturate in the solvent 20. Preferably, the strip of cleaning fabric 13 is soaked and saturated to functional equilibrium with solvent when it is removed from solvent 20. If not, the excess solvent must be removed. Any appropriate method for removing excess solvent may be used. Preferably, the excess solvent is removed by squeezing the strip of cleaning fabric 13 between a pair of rollers 160.

Figure 7A:
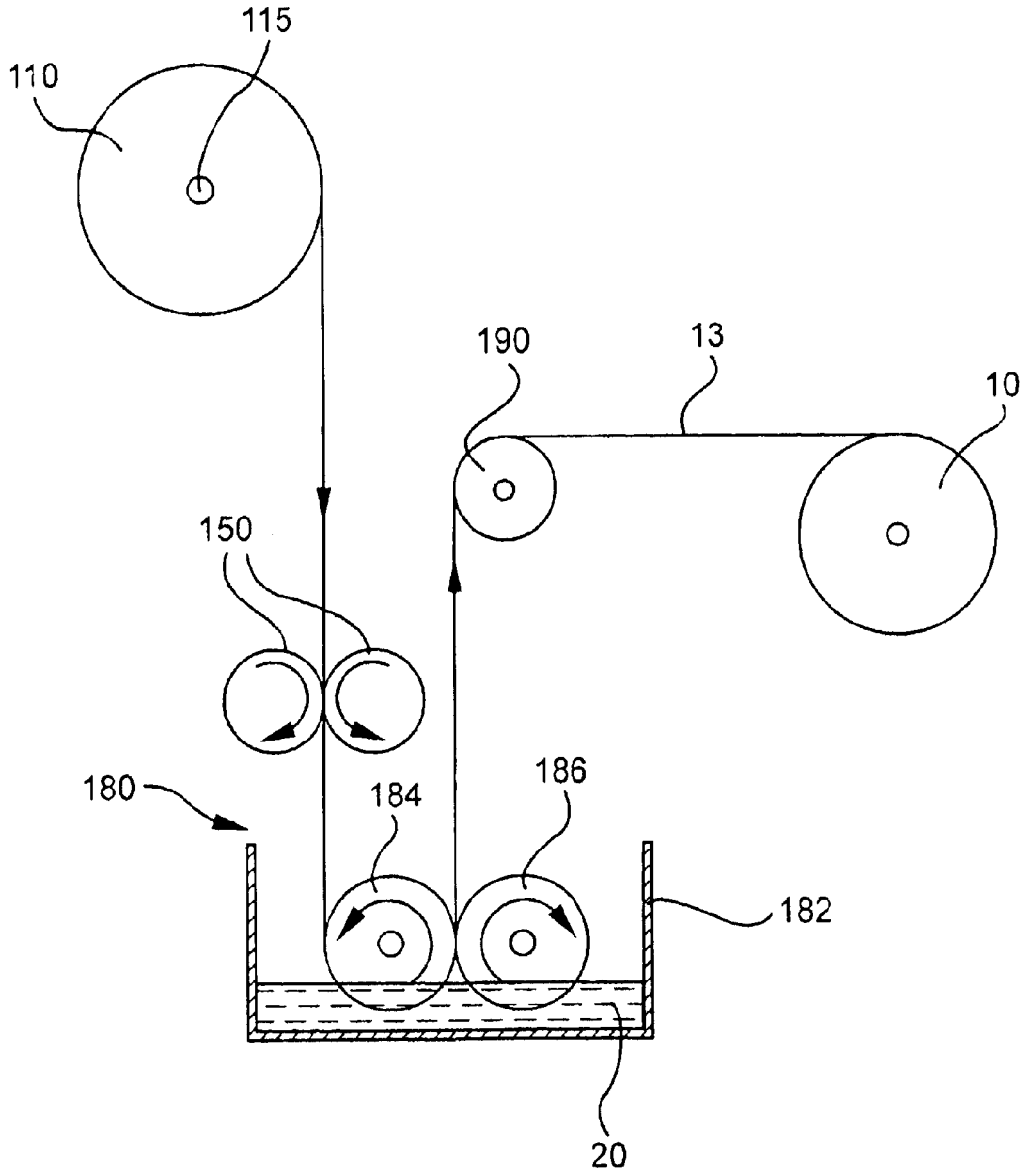
FIG. 7A is a cross-sectional view of an alternate embodiment of a soak on site system according to the present invention in which a same roller is used to both apply and remove solvent.

Yet another possible embodiment is shown in FIG. 7A. In this embodiment, the solvent application system 180 includes a container 182 a dipping roller 184 and a squeezing roller 186. Solvent or cleaning agent 20 is stored in container 182. The dipping roller 184 is used to dip the strip of cleaning fabric 13 into the solvent or cleaning agent 20. The strip of cleaning fabric 13 is soaked and saturated in the solvent or cleaning agent 20. The strip of cleaning fabric 13 is then removed from the solvent and the excess solvent is removed form the strip of cleaning fabric 13 so that it is saturated to functional equilibrium with the solvent 20. This removal may be accomplished by squeezing the strip of cleaning fabric 13 between dipping roller 184 and squeezing roller 184 at a point above solvent 20. An advantage of such a system is that the removed excess solvent will drop into container 182 and thus a separate container for the removed excess solvent will not be required.

Also shown in FIG. 7A is a positioner 190. Positioner 190 is preferably a roller. Positioner 190 may be used to properly position the strip of cleaning fabric 13 is presoaked. Although positioner 190 is only shown in FIG. 7A, a positioner may be used in any embodiment of the invention. Positioners may also be used in the soak on press systems described earlier.

It should be noted that the embodiments shown in FIGS. 6, 7, and 7A do not need to have rolls 150 installed. If rolls 150 are not installed, standard uncalendered fabric is used and less solvent stability is obtained.

After being presoaked on site, the cleaning fabric supply roll 10 having a strip of cleaning fabric 13 is then placed on a printing press having a cylinder 100 to be cleaned.

Figure 8:
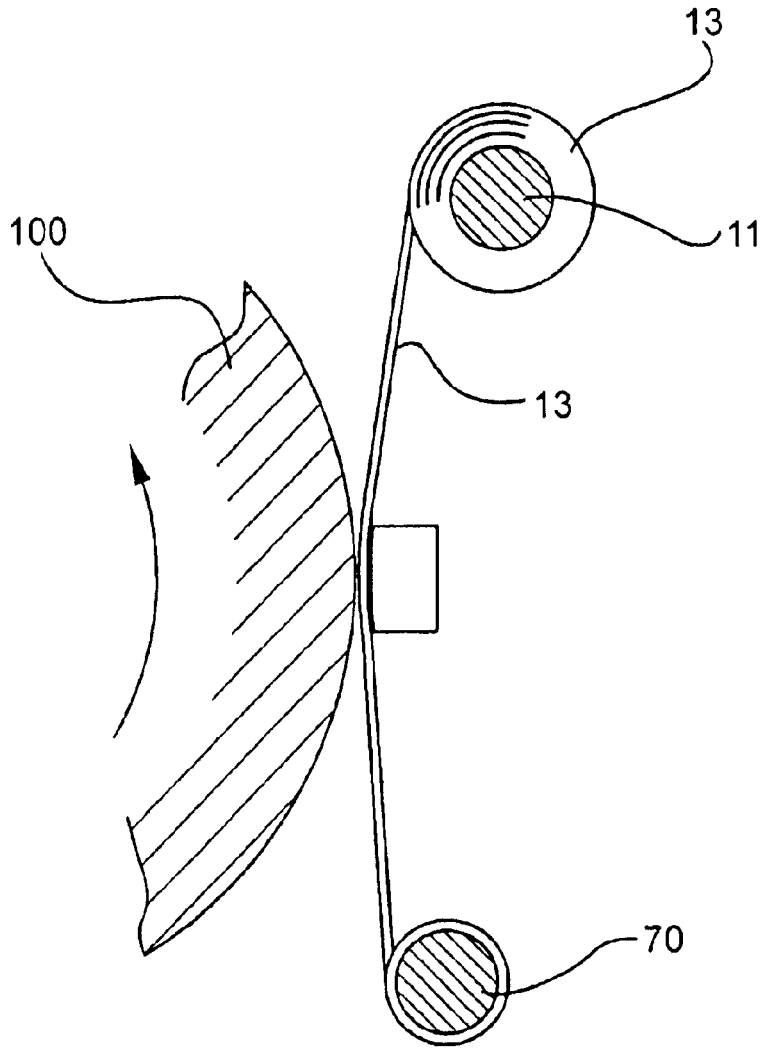
FIG. 8 is a partial cross-sectional view of a cylinder to be cleaned and a soaked on site cleaning system according to the present invention.

The printing press further includes a means for properly positioning the cleaning fabric to allow cleaning of the cylinder 100. Several ways exist for this result to be achieved. For example, the cleaning fabric 13 may be positioned so that it is adjacent the cylinder 100 to be cleaned. In another example, the cleaning fabric 13 may be adjacent to and operatively associated with the cylinder 100 to be cleaned. In yet another possible embodiment, the cleaning fabric 13 is operatively associated with the cylinder 100 to allow cleaning the cylinder 100 as the fabric 13 is fed past the cylinder 100. One possible arrangement is shown in FIG. 8. The person of ordinary skill in the art will be aware of many other configurations that will work for the invention's intended purpose without undue experimentation. These examples are merely exemplary and are not meant to limit how the invention may be used.

A distinct advantage of the cleaning system of this invention is that it eliminates the need for complex apparatus, such as pumps, spray bars, manifold lines, valves and the like, especially as part of the automatic blanket cleaning systems used on printing machinery to introduce cleansing solvents or solutions to the cleaning fabric just prior to use.

In addition, the cleaning system of this invention provides numerous other advantages. For example, it is relatively simple in construction, employs readily available materials, and can be made in a relatively simple and forward manner without resort to highly complex and expensive procedures which necessitate the use of elaborate machinery. Additionally, the invention is preferable to the invention discussed in U.S. Pat. No. 5,368,157 to Gasparrini et al. in that it provides for less solvent displacement during storage and thus less of a change in the fabric roll's center of gravity. Numerous other advantages of this invention will be readily apparent to those skilled in the art.

It will remain understood by those skilled in the art that the present invention in its broader aspects is not limited to the particular embodiments shown and described herein, and that variations may be made which are within the scope of the accompanying claims without departing from the principles of the invention and without sacrificing its chief advantages.

We claim:

1. A device for preparing a soaked cleaning fabric for use in cleaning a printing press comprising:

means for mounting a first supply roll having a strip of cleaning fabric wound around a shaft;

calendaring means for reducing the thickness and increasing the length of said strip of cleaning fabric;

solvent applying means adjacent to said calendaring means for applying a low volatility, organic compound solvent which does not readily evaporate at ambient pressure and temperature to said strip of cleaning fabric for forming a soaked strip of cleaning fabric, wherein said calendaring means increases solvent's wettability and distribution in said strip of cleaning fabric;

means for forming a second supply roll comprising said soaked strip of cleaning fabric, wherein the diameter of said second supply roll is not substantially increased when said calendaring means reduces the thickness and increases the length of said strip of said cleaning fabric; and an excess solvent removing means interposed between said solvent applying means and said second supply roll for removing excess solvent from said strip of cleaning fabric and obtaining said strip of cleaning fabric saturated to functional equilibrium with said solvent.

2. The device for soaking a strip of cleaning fabric on site as defined by claim 1 further comprising a squeezer operatively associated with said solvent applying means to squeeze said strip of cleaning fabric between said solvent applying means and said squeezer.

3. The device for soaking a strip of cleaning fabric on site as defined by claim 2 wherein said solvent applying means comprises at least one roller and said squeezer comprises at least one roller.

4. The device in claim 1, wherein the calendaring means further comprises at least a pair of rollers adjustable in temperature.

5. The device in claim 4, wherein said rollers are heated at a temperature above room temperature.

6. The device in claim 1, wherein said solvent applying means further comprises a solvent supply roller, a rotating roller, and an application roller such that said supply roller is partially submerged in solvent, and rotation of said solvent supply roller and said application roller causes solvent to transfer from said solvent supply roller to said application roller which then applies solvent to said strip of cleaning fabric such that said rotating roller is adjacent to said application roller and said strip of cleaning fabric is place between and adjacent to said rotating roller and said application roller for the application roller to apply a measured amount of solvent in contact with said strip of cleaning fabric.

7. The device in claim 1, wherein said solvent applying means further comprises a rotatably mounted roller submerged in solvent for dipping said strip of cleaning fabric into solvent.

8. The device in claim 1, wherein said solvent applying means further comprises a dipping roller submerged in solvent, and said excess solvent removing means further comprises a squeezing roller juxtaposed to said dipping roller and submerged in solvent.

* * * * *

UNITED STATES PATENT AND TRADEMARK OFFICE

CERTIFICATE OF CORRECTION

PATENT NO. : 6,849,124 B1 
DATED : February 1, 2005
INVENTOR(S) : C. Robert Gasparrini, Peter E. Anselmo and Walter H. Cano It is certified that error appears in the above-identified patent and that said Letters Patent is hereby corrected as shown below:

Title page,
Item [54], Title, delete "SOAK ON SITE AND SOAK PRESS CLEANING SYSTEM AND METHOD OF USING SAME" and insert -- SOAK ON SITE AND SOAK ON PRESS CLEANING SYSTEM AND METHOD OF USING SAME --;

Column 8,
Line 12, delete "my" and insert -- may --;

Column 9,
Line 26, delete "70" and insert -- 30 --;

Column 12,
Line 57, delete "184" and insert -- 186 --

Signed and Sealed this

Twenty-fourth Day of May, 2005

JON W. DUDAS
*Director of the United States Patent and Trademark Office*